US007707790B2

(12) United States Patent
Williams et al.

(10) Patent No.: US 7,707,790 B2
(45) Date of Patent: May 4, 2010

(54) OFFICE SYSTEM

(75) Inventors: Otto N. Williams, Berkeley, CA (US); Joe A. Noble, San Francisco, CA (US); Todd J. Sorel, Hayward, CA (US); Jess A. Sorel, Oakland, CA (US); Bryan T. White, Freemont, CA (US); Christopher A. Luomanen, San Francisco, CA (US); Max Williams, Castro Valley, CA (US); David E. Simon, Bainbridge Island, WA (US); Jon H. Lefors, San Francisco, CA (US)

(73) Assignee: Steelcase Inc., Grand Rapids, MI (US)

( * ) Notice: Subject to any disclaimer, the term of this patent is extended or adjusted under 35 U.S.C. 154(b) by 1528 days.

(21) Appl. No.: 10/835,430

(22) Filed: Apr. 29, 2004

(65) Prior Publication Data

US 2005/0016080 A1 Jan. 27, 2005

Related U.S. Application Data

(60) Provisional application No. 60/478,052, filed on Jun. 12, 2003.

(51) Int. Cl.
*E04B 2/30* (2006.01)

(52) U.S. Cl. ..... 52/239; 52/238.1; 52/282.3; 52/282.4; 52/281; 160/135

(58) Field of Classification Search ..... 52/280, 52/281, 282.3, 282.4, 285.2, 286, 238.1, 52/239, 243; 403/172, 217
See application file for complete search history.

(56) References Cited

U.S. PATENT DOCUMENTS 140,130 A 6/1873 Fowler
262,312 A 8/1882 Rearden
1,648,582 A 11/1927 Dodge, Jr.
1,864,077 A 6/1932 Lewis et al.
2,058,263 A * 10/1936 Rosendale ..... 312/265.4
2,172,956 A 9/1939 Derman
2,184,363 A 12/1939 Schultz et al.
2,272,819 A 2/1942 Poetsch et al.
2,636,224 A 4/1953 Murdoch et al.
2,933,167 A * 4/1960 Keller ..... 52/580
2,944,861 A 7/1960 Lessin
2,947,093 A 8/1960 Masters (Continued)

*Primary Examiner*—Phi Dieu Tran A
(74) *Attorney, Agent, or Firm*—Price, Heneveld, Cooper, DeWitt & Litton, LLP

(57) ABSTRACT

A free-standing, partition-type furniture system adapted to subdivide an open space of a room, comprising a plurality of first partition panels, each including a first body portion having a pair of side edges, and a first screen member operably coupled to the first partition panel and laterally shiftable with respect to the first partition panel such that the first screen member extends from one of the side edges of the first body portion. The furniture system also includes a plurality of second partition panels each including a second body portion having an upper edge, and a second screen member operably coupled to the second partition panel and vertically shiftable with respect to the second partition panel such that the second screen member extends from the upper edge of the second body portion. The plurality of first and second partition panels are operably coupleable and arrangeable so as to subdivide the open space of a room.

16 Claims, 13 Drawing Sheets

U.S. PATENT DOCUMENTS 2,962,133 A * 11/1960 Kivett et al. ..... 52/580
3,083,417 A 4/1963 Cook
3,212,646 A 10/1965 Propst
3,241,898 A 3/1966 Propst
3,245,741 A 4/1966 Bartlett
3,267,631 A * 8/1966 Hammitt ..... 52/771
3,378,977 A 4/1968 Vervloet
3,425,568 A 2/1969 Albright
3,433,889 A 3/1969 DeVries, Jr.
3,449,877 A * 6/1969 Beckman ..... 52/243.1
3,566,561 A * 3/1971 Tozer ..... 52/127.12
3,712,697 A 1/1973 Kelley et al.
D227,964 S 7/1973 Propst
3,742,911 A 7/1973 Lehe et al.
3,771,847 A 11/1973 Aylworth
3,792,189 A 2/1974 Stengel et al.
D234,659 S 4/1975 Hodges
3,899,228 A 8/1975 Schreiber
RE28,994 E 10/1976 Aylworth
4,121,392 A 10/1978 Plewacki
4,140,356 A 2/1979 Chervanak
4,171,150 A 10/1979 Söderlund
4,231,630 A 11/1980 Propst et al.
4,241,965 A 12/1980 Wilson et al.
4,265,502 A 5/1981 Blodee et al.
4,270,332 A * 6/1981 Montrouil ..... 52/772
4,365,855 A 12/1982 Mark
4,404,776 A 9/1983 Ball et al.
4,413,489 A 11/1983 Hogue
4,429,850 A 2/1984 Weber et al.
4,441,768 A 4/1984 Clarkson
4,473,315 A * 9/1984 Latchinian ..... 403/172
4,497,148 A * 2/1985 Lopez ..... 52/126.3
4,570,402 A 2/1986 Johnson
4,579,403 A 4/1986 Byrne
4,620,339 A 11/1986 Shepheard
4,631,881 A 12/1986 Charman
4,685,255 A 8/1987 Kelley
D293,523 S 1/1988 Handler et al.
4,726,701 A * 2/1988 Thomas ..... 403/172
RE32,687 E 6/1988 Shepheard
4,817,538 A 4/1989 Michaelsen
4,821,477 A 4/1989 Rydqvist
4,833,840 A 5/1989 Kalischewski et al.
4,841,689 A 6/1989 Schussler
4,870,908 A 10/1989 Wolters et al.
4,876,835 A 10/1989 Kelley et al.
D306,672 S 3/1990 Peters
D312,014 S 11/1990 Friedman
5,018,323 A 5/1991 Clausen
5,038,539 A 8/1991 Kelley et al.
5,041,002 A 8/1991 Byrne
D319,549 S 9/1991 van der Burg
D323,251 S 1/1992 Zapf
5,104,332 A 4/1992 McCoy
5,125,202 A 6/1992 Kissinger
5,149,017 A 9/1992 McEntire et al.
5,158,472 A 10/1992 Juhlin
5,214,889 A 6/1993 Nienhuis et al.
5,255,970 A 10/1993 Theosabrata
D341,274 S 11/1993 van den Nieuwelaar
5,309,686 A 5/1994 Underwood et al.
5,394,658 A 3/1995 Schreiner et al.
5,409,308 A 4/1995 Reuter et al.
5,433,046 A 7/1995 MacQuarrie et al.
D372,811 S 8/1996 Muller-Deisig et al.
5,562,469 A 10/1996 Nienhuis et al.
5,590,940 A 1/1997 Richard
5,592,794 A 1/1997 Tundaun
5,707,126 A 1/1998 Neufeld et al.
5,743,193 A 4/1998 Kakuta et al.
5,749,197 A 5/1998 Jolly
5,775,521 A 7/1998 Tisbo
5,778,612 A 7/1998 Kissinger et al.
5,803,563 A 9/1998 Woodward
5,845,980 A 12/1998 Fricano et al.
5,873,205 A 2/1999 Hanlon et al.
5,893,616 A 4/1999 MacDonald et al.
5,906,079 A 5/1999 Brickner et al.
D411,059 S 6/1999 Wolansky et al.
5,913,787 A 6/1999 Edwards
5,918,422 A 7/1999 Bucher, Jr.
5,918,998 A * 7/1999 Pourmand ..... 403/218
5,941,026 A 8/1999 Eisenreich et al.
5,973,264 A 10/1999 O'Connor
5,979,118 A 11/1999 Gortsema et al.
6,053,591 A 4/2000 Kasanic
6,076,308 A 6/2000 Lyon et al.
6,082,841 A 7/2000 Smith et al.
6,107,570 A 8/2000 Suzuki et al.
6,128,877 A 10/2000 Goodman et al.
6,173,543 B1 1/2001 Gortsema et al.
6,189,268 B1 2/2001 Carr et al.
6,250,032 B1 6/2001 Davis et al.
6,349,507 B1 2/2002 Muellerleile
6,378,255 B1 4/2002 Eich et al.
6,394,564 B1 5/2002 Mrotz, III et al.
6,397,534 B1 6/2002 Hager et al.
6,416,339 B1 7/2002 Snow et al.
6,418,671 B1 7/2002 DeRuiter et al.
6,446,396 B1 9/2002 Marangoni et al.
6,481,547 B2 11/2002 Tsukamoto
6,490,829 B1 12/2002 Schreiner et al.
6,497,075 B1 12/2002 Schreiner et al.
6,515,229 B2 2/2003 Aoki et al.
6,553,731 B2 4/2003 Hsueh
6,591,555 B2 7/2003 King et al.
6,612,077 B2 9/2003 Parshad
6,634,149 B2 10/2003 Cates et al.
6,711,871 B2 3/2004 Beirise et al.
6,964,137 B2 * 11/2005 Frascari ..... 52/235
2001/0029707 A1 10/2001 Hsueh
2002/0021060 A1 2/2002 Liu
2002/0052133 A1 5/2002 Henriott et al.
2002/0053174 A1 5/2002 Barmak
2002/0101139 A1 8/2002 Lee
2002/0108330 A1 8/2002 Yu et al.
2002/0189179 A1 12/2002 King et al.
2003/0005654 A1 1/2003 Weber et al.
2003/0051415 A1 3/2003 Remelts et al.
2003/0066248 A1 4/2003 Hsueh
2003/0080656 A1 5/2003 Chen
2004/0003556 A1 1/2004 Zerbst

* cited by examiner

OFFICE SYSTEM

CROSS REFERENCE TO RELATED APPLICATION

This application claims the benefit of U.S. Provisional Application No. 60/478,052, filed Jun. 12, 2003, entitled Office System, which is hereby incorporated herein by reference in its entirety.

BACKGROUND OF THE INVENTION

The present invention relates to an office partition furniture system, and in particular to a free-standing, partition-type furniture system telescopingly expandable in both the lateral and vertical directions, so to easily subdivide an open space within a room, and to adjust to architectural conditions and limitations.

The efficient use of building floor space is an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirement of different tenants. One arrangement commonly used for furnishing open plans includes movable or portable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture."

Numerous partition panel systems have been developed for dividing office workspaces into smaller areas. Some of these partition panel systems utilize prefabricated rectangular partition panel members that have a unitary rigid perimeter frame with decorative cover panels fastened opposite sides thereof. Each perimeter frame member has a rectangular shape, and is fabricated and shipped as a single unit, often with the decorative cover panels pre-fastened to the frame. During installation, the prefabricated perimeter frame of each panel member is fastened to the perimeter frame of an adjacent panel member along the vertical edges thereof, either directly, or by a separate fastener post. Each partition panel member includes two height adjustable feet or glides along the bottom edge of each panel member, with one glide being located adjacent each vertical panel edge. Since there are two vertical frame members at each panel joint, this type of panel construction results in structural redundancy. In addition, since each glide must be properly adjusted for height, this configuration requires adjustment of both glides at each panel joint during assembly. Furthermore, although longer panels typically have a lower cost per unit length, longer panels are difficult to handle, which places a practical limit on the size of the partition panel member that can be shipped and installed as a prefabricated unit.

Other partition panel systems utilize prefabricated rectangular partition panel members having a unitary perimeter frame that attaches to a post member along each vertical panel edge. Although this type of design may have a single glide at each post, each panel-to-post connection has at least two vertical structural members. Since only a single vertical member is needed to provide support and height adjustment, this type of system has redundant structure. In addition, the rectangular partition panel members are manufactured and shipped as a unit, limiting the size of the partition panel members that can be used.

A furniture system is desired that can be easily and quickly assembled, may be easily rearranged and reconfigured to satisfy the needs of a changing business environment in a particular setting, provides a low-cost alternative to complicated partition panel systems, and allows for reduced, as well as simplified ordering, assembling, managing furniture assets and shipping costs while simultaneously providing adequate room-dividing properties.

SUMMARY OF THE INVENTION

One aspect of the present invention is to provide a furniture system that includes a base member, a pedestal extending upwardly from and supported by the base member, and a worksurface supported by the pedestal. The furniture system also includes a partition member extending upwardly from and supported by the base member and including a vertically-shiftable screen member extendable from an upper edge of the partition member, wherein the partition member is spaced apart from the pedestal.

Another aspect of the present invention is to provide a furniture system that includes a worksurface, a partition panel supporting the worksurface, and a screen member vertically shiftably supported by the partition member such that the screen member is extendable from an upper surface of the partition panel.

Yet another aspect of the present invention is to provide a free-standing, partition type furniture system that includes at least one partition panel configured to subdivide a space within a room, and a screen member operably coupled to the partition panel and laterally shiftable with respect to the partition panel, the screen member including a first side and a second side opposite the first side, wherein the first side of the screen member includes and accessory unit.

Another aspect of the present invention is to provide a free-standing partition-type furniture system adapted to subdivide a floor space of a room that includes a plurality of first partition panels each including a first body portion having a pair of side edges, and a first screen member operably coupled to the first partition panel and laterally shiftable with respect to the first partition panel such that the first screen member extends from one of the side edges of the first body portion. The furniture system also includes a plurality of second partition panels each including a second body portion having an upper edge, and a second screen member operably coupled to the second partition panel and vertically shiftable with respect to the second partition panel such the second screen member extends from the upper edge of the second body portion. The plurality of first and second partition panels are operably coupleable and arrangeable so as to subdivide an open space of a room Still another aspect of the present invention is to provide a furniture system that includes a cabinet member having a pair of side walls, a top wall, a bottom wall and a rear wall that cooperate to form a box-like structure having an open front, a worksurface supported within the cabinet member, and a screen member laterally shiftably supported within the rear wall such that the screen member is extendable from one of the side walls of the cabinet structure.

Another aspect of the present invention is to provide a plurality of work areas within an open space of a room, each work area including at least one first partition panel, and at least one desk assembly. Each first partition panel includes a first body portion having a pair of side edges, and a first screen member operably coupled to the first body portion and laterally shiftable with respect to the first body portion such that the first screen member extends from one of the side edges of the first body portion. Each desk assembly including a first worksurface, and a second worksurface overlapping the first worksurface and laterally shiftable with respect to the first worksurface. The at least one partition panel in the at least one desk assembly cooperate and are reconfigurable so as to subdivide a given open space of a room.

Another aspect of the present invention is to provide a furniture system that comprises a partition panel, a first worksurface supported from the partition panel, and a second worksurface at least partially underlying the first worksurface and laterally shiftable with respect to the first worksurface. The furniture system further comprises a support member extending between the first worksurface and the second worksurface, thereby supporting the first worksurface from the second worksurface.

Still yet another aspect of the present invention is to provide a plurality of work areas within an open space of a room, each work area including two first partition panels each including a first body portion having a pair of side edges, a first screen member operably coupled to the first body portion and laterally shiftable with respect to the first body portion such that the first screen member extends from one of the side edges of the first body portion. The at least two first partition panels cooperate and are reconfigurable so as to subdivide a given open space of a room.

Still another aspect of the present invention is to provide a freestanding partition panel assembly that comprises a body portion having a pair of side edges, and a screen member operably coupled to the body portion and laterally shiftable with respect to the body portion such that the screen member extends from one of the side edges of the body portion. The screen member comprises a top frame member having at least one upper guide channel, a bottom frame member having at least one lower guide channel, and at least one divider that is slidably received within the upper guide channel and the lower guide channel and is selectively horizontally repositionable therein.

Another aspect of the present invention is to provide a furniture system that comprises a worksurface, and a partition panel at least partially supporting the worksurface, wherein the partition panel includes a top frame member having at least one upper guide channel and a bottom frame member having at least one lower guide channel. The furniture system also comprises at least one divider shiftably received within the at least one upper guide channel and the at least one lower guide channel of the partition member and selectively horizontally repositionable therein.

Another aspect of the present invention is to provide a connector assembly for freestanding partition-type office system of the type including a plurality of panel members, each panel member having at least one frame member, wherein the at least one frame member has a pair of inwardly-extending channels. The connector assembly comprises a pair of engagement members, wherein each engagement member includes a pair of legs, an inner wall located at and connected to a proximal end of the legs, a web portion located along a length and connected to the legs, and a pair of tab portions located at a distal end of the legs, wherein the inner wall of at least one of the engagement members includes an aperture extending therethrough. The connector assembly also includes an actuator operably received the aperture of the inner wall of the one of the engagement members such that selective actuation of the actuator member forces the inner walls of the pair of engagement members away from one another, and the tab portions to frictionally engage a pair of channels of a frame member, thereby coupling a pair of panel members together.

Another aspect of the present invention is to provide a freestanding partition-type system adapted to subdivide an open space of a room, the system comprising a first panel member having a first frame member extending along an edge thereof, wherein the first frame member includes a pair of channels extending along a length thereof, and a second panel member having a second frame member extending along an edge thereof, wherein the second frame member includes a pair of channels extending along a length thereof. The system also comprises a pair of engagement members, wherein each engagement member includes a pair of legs, an inner wall located at and connected to a proximal end of the legs, a web portion located along a length of and connected to the legs, and a pair of tab portions located at a distal end of the legs, wherein the inner wall of at least one of the engagement members includes an aperture extending therethrough. The system further comprises an actuator operably received within the aperture of the inner wall of one of the engagement members such that selective actuation of the actuator member forces the inner walls of the pair of engagement members away from one another, and the tab portions of each engagement member to frictionally engage one of the channels of the frame member of each of the panel members, thereby coupling the first and second panel members together.

The present inventive furniture systems provide an uncomplicated design, can be easily and quickly arranged to subdivide an open space of a room, and are therefore efficient in use, provide a low-cost alternative to furniture systems that include an arrangement of complicated and difficult to assemble partition panels, and are particularly well adapted for the proposed use.

These and other advantages of the invention will be further understood and appreciated by those skilled in the art by reference to following written specification, claims and appended drawings.

DETAILED DESCRIPTION OF THE PREFERRED EMBODIMENTS

Figure 2:
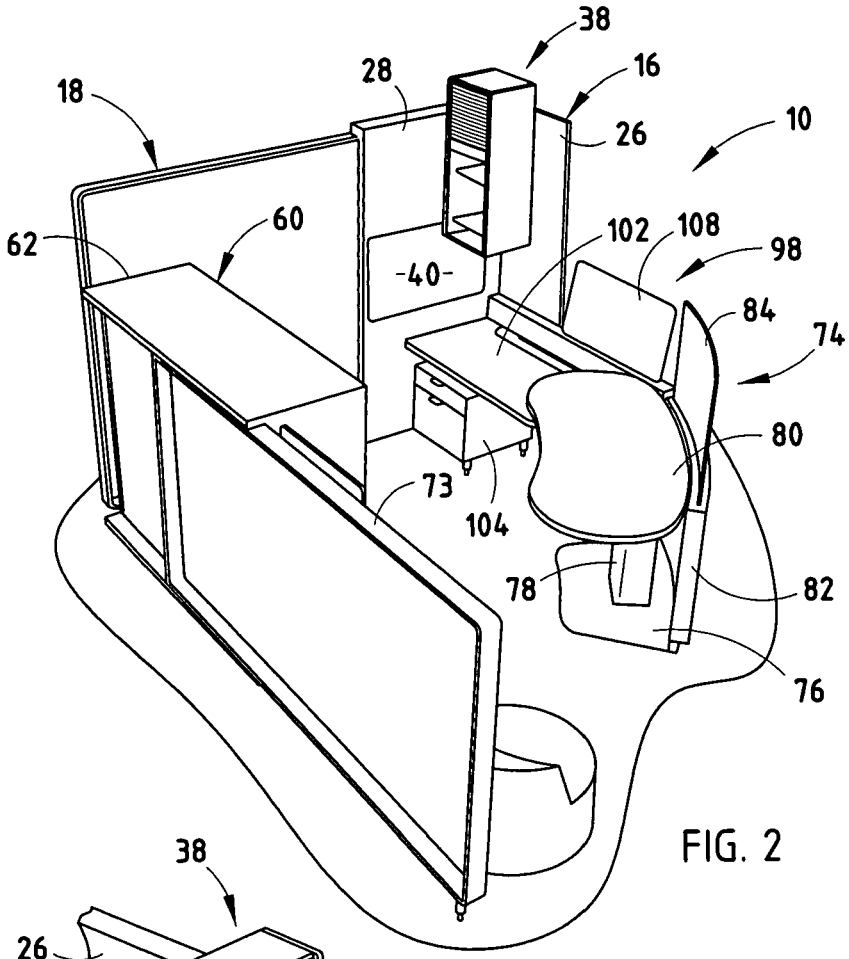
FIG. 2 is a top perspective view of the plurality of furniture systems subdividing the space within the room.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
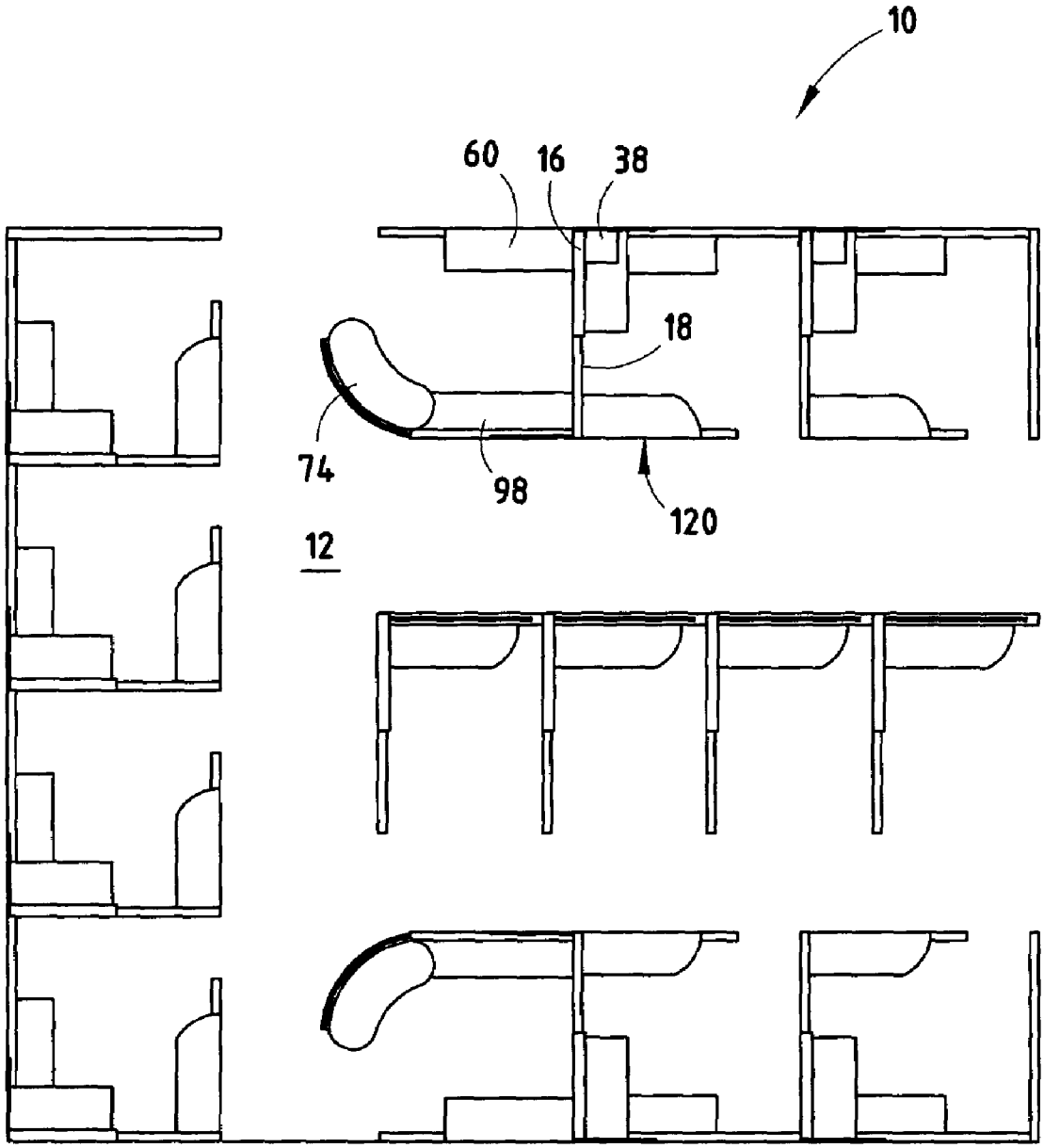
FIG. 1 is a top view of a plurality of furniture systems embodying the present invention, and cooperating to subdivide an open space of a room.

The reference numeral 10 (FIGS. 1 and 2) generally designates a plurality of furniture systems embodying the present invention, and cooperating to subdivide an open floor space 12 of a room. In the illustrated example, a first furniture system 14 (FIG. 3) includes a partition assembly 16, and a first screen member 18 laterally shiftable with respect to the partition assembly 16. The screen member 18 (FIG. 4) includes an outer frame 19 and a supported skin 21. The frame 19 is preferably constructed of an extruded aluminum, while the skin 21 is preferably constructed of a woven polypropylene, wherein the weave of the PVC may be provided loosely to allow for the passage of light, or tightly, thereby providing an improved backdrop for purposes such as a projector screen 18 includes a first side 20 and second side 22 opposite the first side 20. The first side 20 (FIG. 4) includes a plurality of accessory units 24, as discussed below. In use, the screen member 18 is laterally shifted from within the partition assembly 16, such that the first side 20 of the screen member 18 is accessible, thereby allowing access to the accessory units 24 located on the first side 20 of the screen member 18. It should be noted that the partition assembly 16 is preferably configured such that at least some portion of the first side 20 of the screen member 18 is always accessible.

Figure 5:
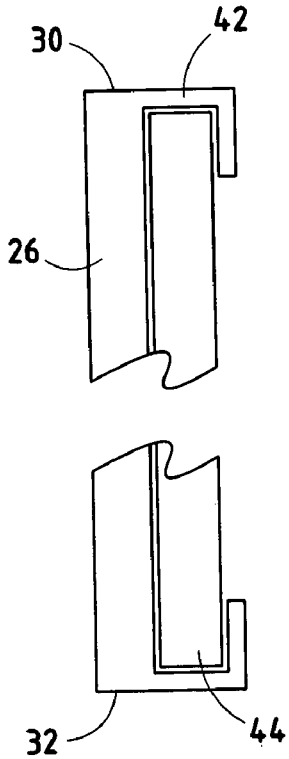
FIG. 5 is an end view of the partition assembly and the first screen member.

The partition assembly 16 includes a first panel member 26 and a second panel member 28 operably coupled so as to form a substantially orthogonal angle. The first panel member 26 includes an upper edge 30, a lower edge 32, and a side edge 34. The first and second panel members 26, 28 are supported above a floor surface 35 by a plurality of legs 36, however, it should be noted that the lower edge 32 of the first panel member 26 may be directly supported by the floor surface 35. The first panel member 26 and the second panel member 28 are provided with a plurality of apertures and/or mechanical fasteners (not shown) so as to support devices such as an overhead storage unit 38, a marker board 40, and the like therefrom. The upper edge 30 (FIG. 5) of the first panel member 26 includes an upper channel 42, while the lower edge 32 includes a lower channel 34, wherein the upper and lower channels 42, 44 are configured to telescopingly receive the screen member 18 therebetween.

Figure 6A:
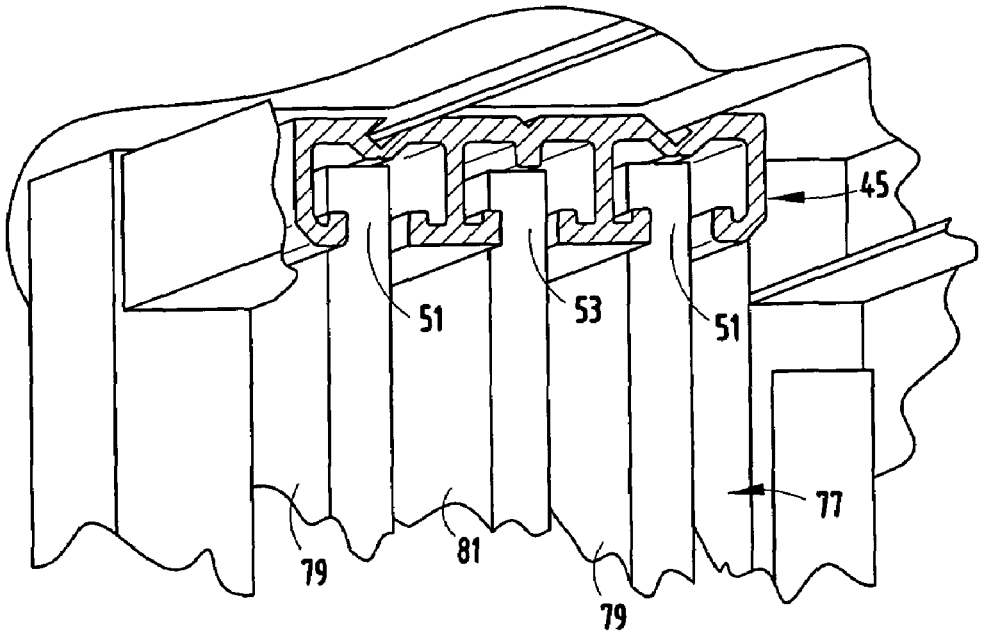
FIG. 6A is a cross-sectional perspective view of a top frame member of the laterally shiftable screen, taken along line VI-VI, FIG. 3.

The screen member 18 includes the first side 20, the second side 22, an upper edge 46, a lower edge 48, and a distal side edge 50. The screen member 18 further includes a top frame member 45, a bottom frame member 47, a side frame member 49, and corner members 31 extending between and connecting the top and bottom frame members 45, 47 with the side frame member 49. The top and bottom frame members 45, 47 (FIG. 6A) are preferably extruded and include a pair of T-shaped outer channels 51 and a T-shaped center channel 53. The top frame member 45 is oriented such that the channels 51, 53 are downwardly disposed, while the bottom frame member is oriented such that the channels 51, 53 are upwardly disposed. The screen member 18 is supported in part by a leg 52 extending downwardly from the lower edge 48 and located proximate the distal side edge 50. In assembly, the upper edge 46 and the lower edge 48 of the screen member 18 are telescopingly received within the upper channel 42 and the lower channel 44 of the first panel member 26, respectively, such that the screen member 18 can be laterally shifted from within the first panel member 26 in a direction as indicated and represented by a direction arrow 49, so as to subdivide the space 12 of the room. Preferably, the screen member 18 will be positioned with respect to the first panel member 26 by skilled personnel familiar with such furniture systems, and that the screen member 18 will not be freely shiftable within the first panel member 26 by a casual operator. It should be noted that while the second side 22 of the screen member 18 is accessible when the screen member 18 is recessed within the first panel member 26, it is envisioned that the first panel member 26 may be configured such that the first screen member 18 is completely received within the first panel member 26 such that a portion of the second side 22 received within the first panel member 26 is not accessible.

Figure 6B:
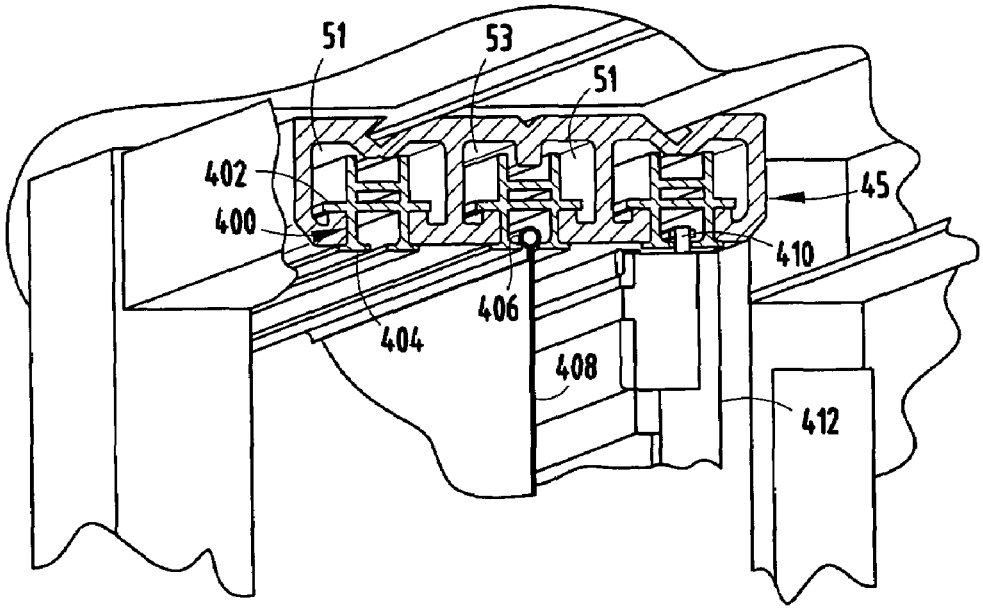
FIG. 6B is a cross-sectional perspective view of the top member of the screen.

The accessory units 24 (FIG. 3) of screen member 18 include utilitarian items such as a marker board 54, a segmented paper organizer or "ladder" 56, a hook 58 suitable to hangingly receive garments such as a coat thereon, and other accessory units compatible for use within an office environment. Alternatively, a plurality of slidable dividers 77 (FIG. 6A) may replace the accessory units 24. Specifically, the dividers 77 include a pair of opaque, mesh-screen dividers 79 slidably received within the outer channels 51 of the top and bottom frame members 45, 47, and a translucent divider 81 slidably received within the center channel 53. Alternatively, an extruded slider support 400 (FIG. 6B) is inserted into each of the channels 51, 53. Each slider support 400 is C-shaped and includes a pair of outwardly-extending support legs 402 for supporting the support 400 within the associated channel 51, 53, and a pair of inwardly-extending support legs 404 that are adapted to support an upwardly-located loop 406 of a screen member 408, and a roller assembly 410 for supporting a utility board 412, such as a white-board, a tack-board, or the like.

The plurality of furniture systems 10 also include a second furniture system 98 that includes a partition member 100, a worksurface 102 at least in part supported by the partition member 100, and a cabinet member 104 including a plurality of slidably extendable drawers 106, wherein the worksurface 102 is in part supported by the cabinet member 104. A screen member 108, similar to screen member 84, is telescopingly adjustable from within the partition member 100 in a direction as indicated and represented by directional arrow 110. The partition member 100 is supported by a distally-located support leg 112, while the worksurface 102 is at least in part supported by a distally-located support leg 114.

Alternatively, the second furniture system 98 is replaced by a third furniture system 120 (FIGS. 7A and 7B) that includes a partition member 122, a worksurface 124 at least in part supported by the partition member 122, and a cabinet member 126. The partition member 122 includes a top frame member 128, a bottom frame member 130, a pair of side frame members 132, and corner members 133. The top and bottom frame members 128, 130 are preferably extruded to include outer and central channel members similar to those described above with respect to the top and bottom frame member 45, 47 of the screen member 18, and that are configured to slidably support translucent panels 135 and an opaque panel 137 therein, as further detailed below.

Figure 8:
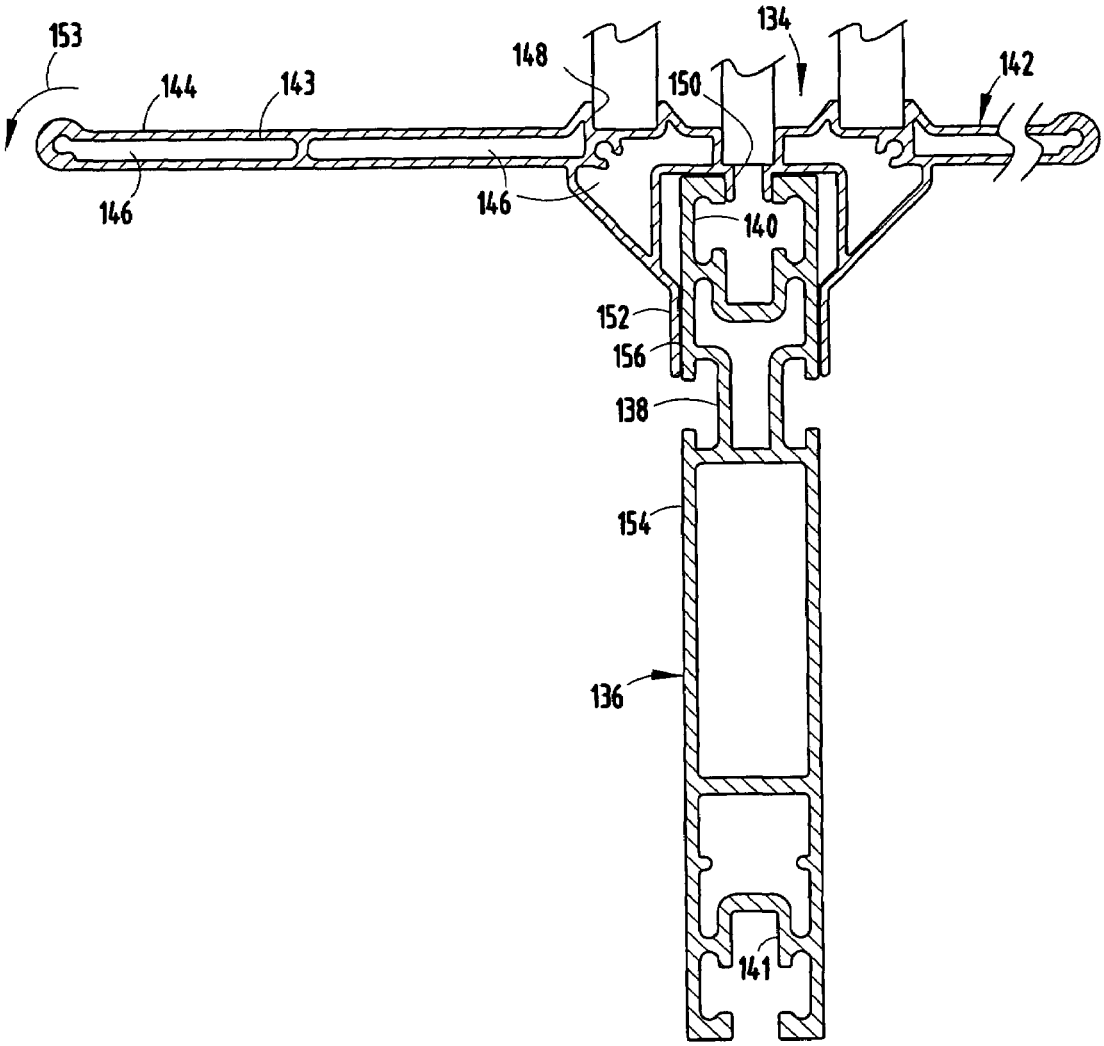
FIG. 8 is a cross-sectional view of a sill assembly, taken along the line VIII-VIII, FIG. 7.
Figure 9:
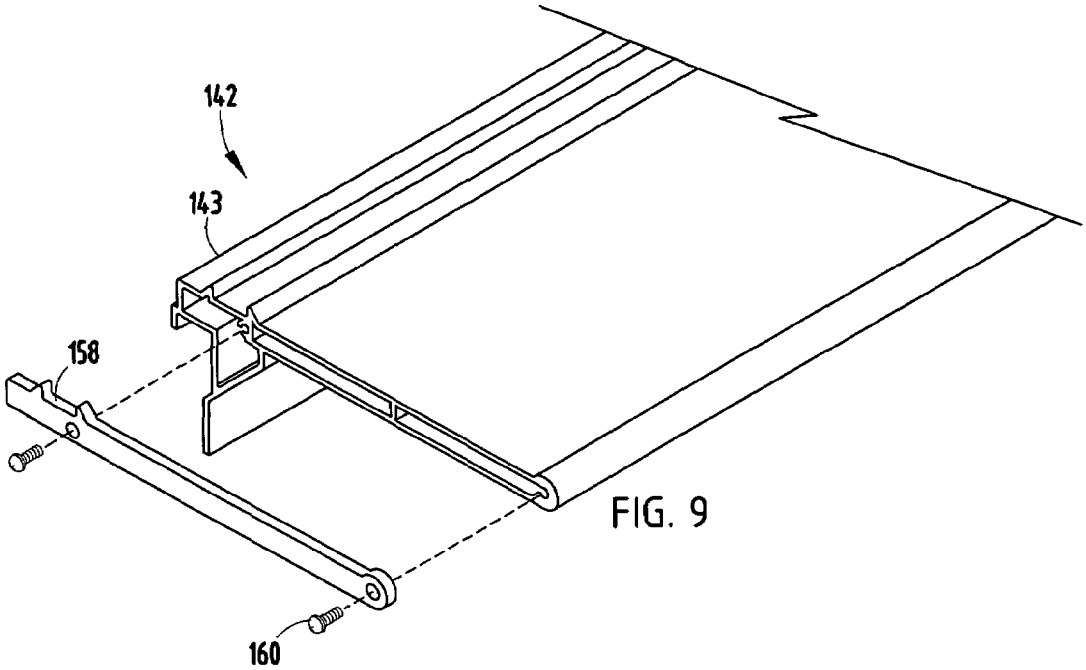
FIG. 9 is an exploded perspective view of an end of a shelf assembly of the sill assembly.

The partition member 122 further includes a sill assembly 134 (FIG. 8) that includes an extruded central frame member 136 extending between and fixedly coupled to the side frame members 132 and having a pair of T-shaped channels 138 extending longitudinally along the side thereof, an upwardly-disposed T-shaped top channel 140 extending longitudinally along a top thereof, and a downwardly-disposed, T-shaped bottom channel 141 extending longitudinally along a bottom thereof. The sill assembly 134 further includes a pair of sill shelf assemblies 142 (FIGS. 8 and 9) supported in a cantilevered manner from the central frame member 136. Specifically, each sill shelf 142 is preferably extruded and includes a top surface 144, a plurality of hollow interior compartments 146, a longitudinally-extending and upwardly-opening channel 148, a rearwardly-located and downwardly-extending hook member 150, and a downwardly-extending abutment flange 152.

In assembly, each sill shelf 142 is supported from the partition member 122 by inserting the hook member 150 of the associated sill shelf 142 into the top channel 140 of the central frame member 136 and allowing the sill shelf 142 to rotate downwardly in a direction as indicated by directional arrow 153 until the abutment surface 152 of the sill shelf 142 abuts a side surface 154 of the central frame member 136. An adhesive 156, such as a double-sided adhesive tape, is placed between points of contact between the associated sill shelf 142 and the central member 136. The sill shelf assembly 146 also includes end caps 158 that cover the exposed end of the compartments 146, and which are held in place by one-way push-in fasteners such as buttons 160.

Figure 10:
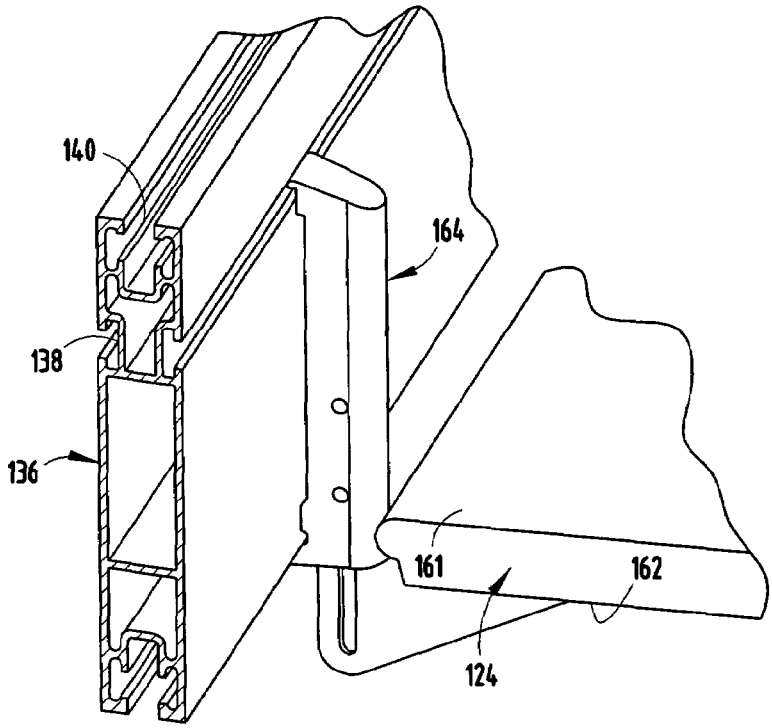
FIG. 10 is an enlarged perspective view of a first worksurface supported by a hanger assembly, taken of area X-X, FIG. 7.
Figure 11:
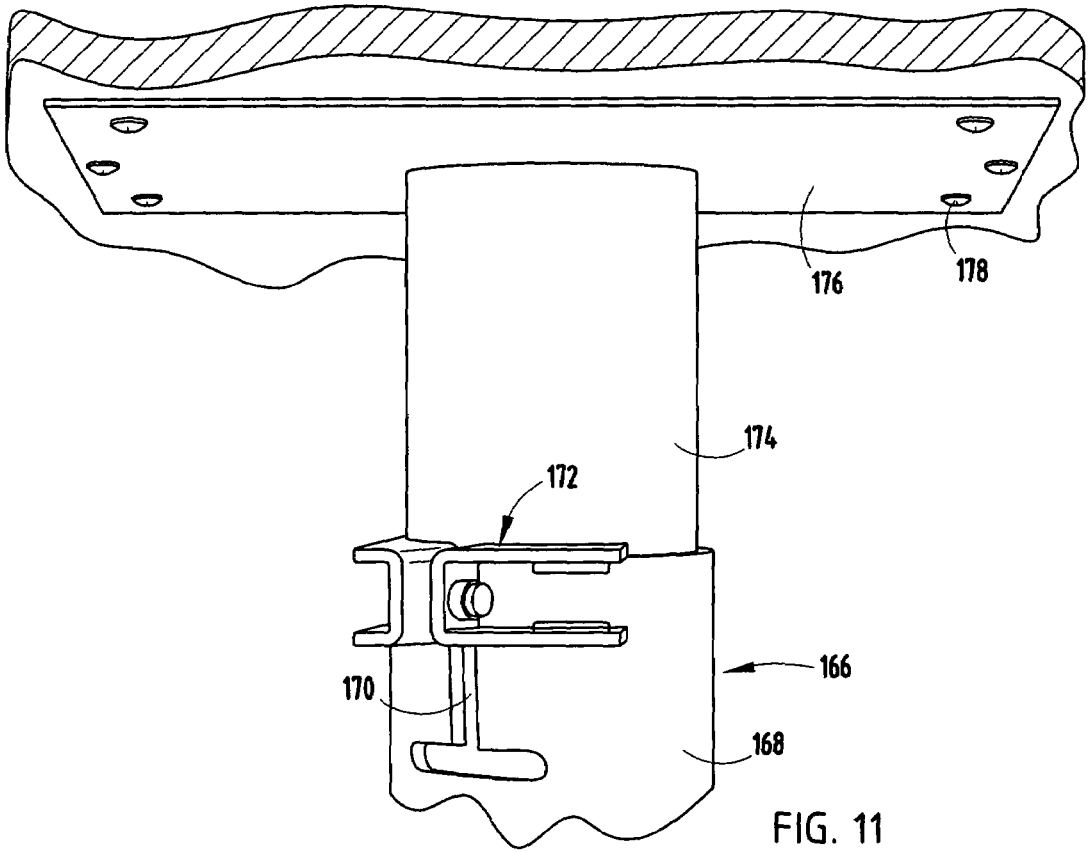
FIG. 11 is an enlarged perspective view of a first leg assembly supporting the first worksurface, taken of area XI-XI, FIG. 7.

The worksurface 124 includes a top surface 161 and a bottom surface 162. The worksurface 124 is supported by a pair of hanger assemblies 164, a leg assembly 166 and leg assembly 180. Each leg assembly 166 (FIG. 10) engages one of the side channels 138 and the bottom channel 141 of the central frame member 136. The construction and manner of engagement of the hanger assemblies 164 are fully described and disclosed in U.S. patent application Ser. No. 10/087,324, entitled Post And Beam Furniture System, the disclosure of which is herein incorporated by reference in its entirety. It should be noted that the hanger assemblies 164 allow adjustment of the relative height of the worksurface 124 with respect to the partition member 122. The leg assembly 166 is telescopingly adjustable and extends from the floor 135 and is fixedly attached to the bottom surface 162 of the worksurface 124. The leg assembly 166 (FIG. 11) includes an outer portion 168 having a circular cross-sectional configuration, an inverted T-shaped relief 170, and a threadably actuated clamp 172 spanning the relief 170. The leg assembly 166 further includes an inner portion 174 having a circular cross-sectional configuration with a diameter slightly smaller than an inner diameter of the outer portion 168, and telescopingly received within the outer portion 168. The leg assembly 166 further includes a support plate 176 fixedly connected to a distal end of the inner portion 174 and fixedly connected to the bottom surface 162 of the worksurface 124 by a plurality of mechanical fasteners such as screws 178. The relative height of the worksurface 124 above the floor surface 35 may be adjusted by loosening the clamping mechanism 172, thereby allowing the relief 170 of the outer portion 168 to expand and the inner portion 174 to telescope within the outer portion 168. The height of the worksurface 124 above the floor surface 35 is then secured by tightening the clamping assembly 172, such that the relief 170 is contracted and the inner portion 174 is tightly secured within the outer portion 168.

Figure 12:
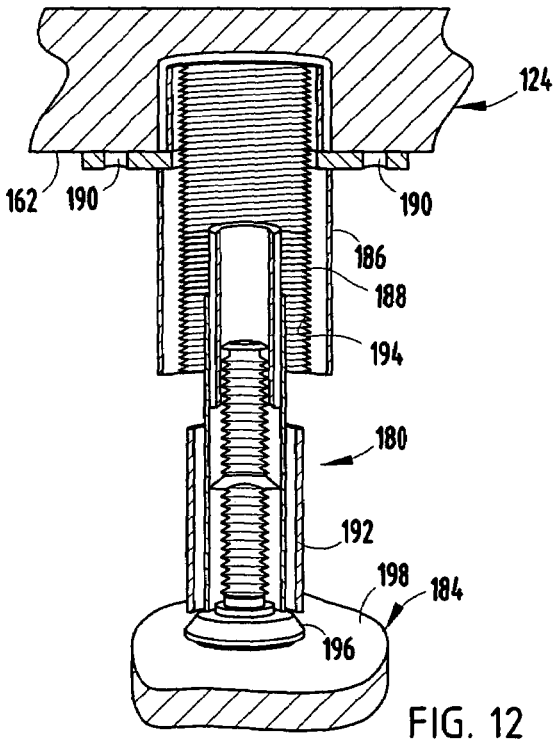
FIG. 12 is an enlarged perspective view of a second leg assembly supporting the first worksurface above a second worksurface, taken of area XII-XII, FIG. 7.

The leg assembly 180 is fixedly attached to the bottom surface 162 of the worksurface 124 and extends downwardly to and is supported by a worksurface 184 of the cabinet member 126. Specifically, the leg assembly 180 (FIG. 12) includes an upper portion 186 having a circular cross-sectional configuration and an internal thread 188, a support plate 190 fixedly secured to an end of the upper portion 186 and fixedly attached to the bottom surface 162 of the worksurface 124 by a plurality of mechanical fasteners such as screws 190, and a lower portion 192 having a circular cross-sectional configuration and an external thread 194 that threadably mates with the internal thread 188 of the upper portion 186, thereby allowing the overall length of the leg assembly 180 to be threadably adjusted. The leg assembly 180 further includes a guide pad 196 fixedly secured to a distal end of the lower portion 192. The guide pad 196 is preferably constructed of a felt material, or other material suitable for such applications. In operation, the guide pad 196 abuts and protects a top surface 198 of the worksurface 184 when the relative location of the worksurface 124 and the worksurface 184 are changed with respect to one another.

Figure 13:
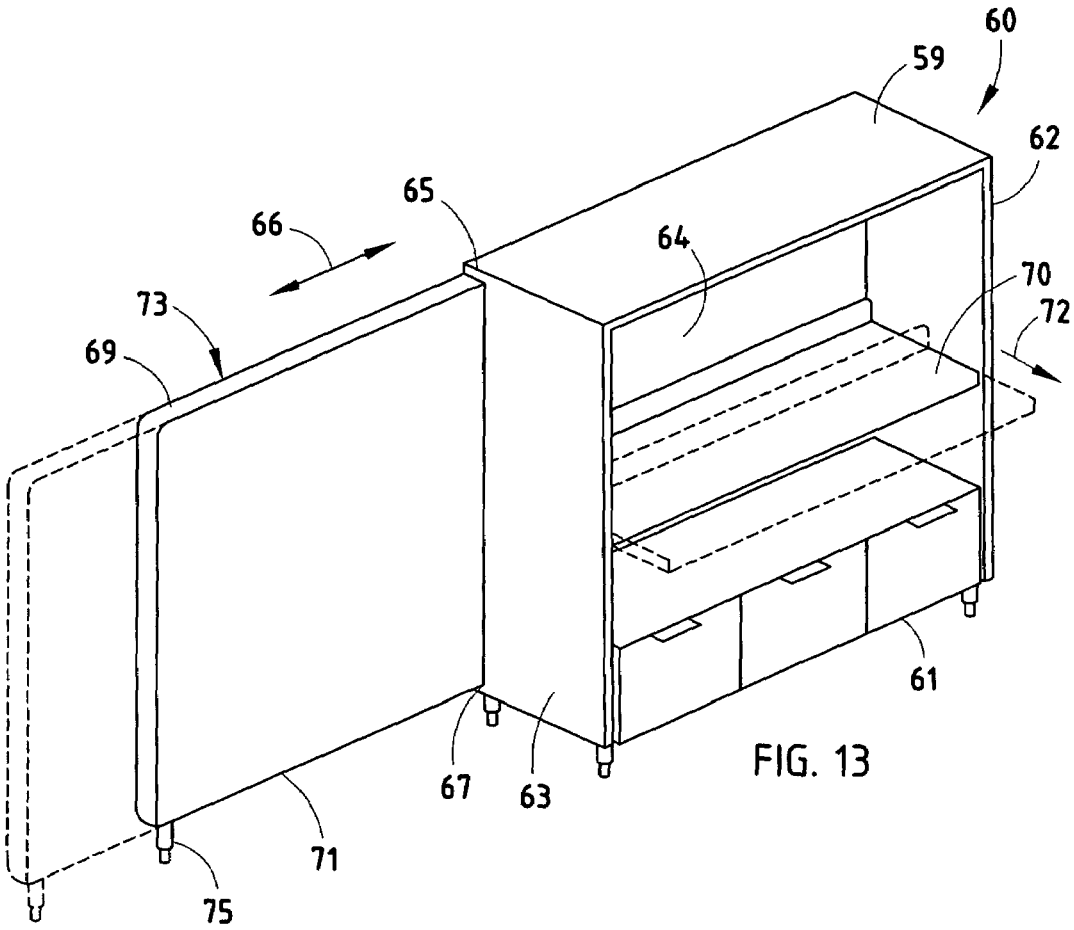
FIG. 13 is a second furniture system, showing the laterally-shiftable screen member in a retracted position in solid line, and an extended position in dashed line.

An armoire-type workstation 60 (FIG. 13) includes a cabinet member 62 having a top wall 59, a bottom wall 61, a pair of side walls 63, and a planar rear wall 64. The rear wall 64 includes an upper channel 65 and a lower channel 67 that telescopingly receive an upper edge 69 and a lower edge 71 of a screen member 73 therein, such that the screen member 73 is laterally shiftable within the cabinet member 62 in a direction as indicated and represented by directional arrow 66 in similar manner as described above. The screen member 73 is at least in part supported by a distally-located leg 75 when the screen member 73 is extended from within the cabinet member 62. The workstation 60 includes a laterally-shiftable worksurface 70 located therein and which is moveable in a direction as indicated and represented by directional arrow 72. The work station 60 is utilized and cooperates within the plurality of furniture systems 10 to subdivide the space 12 within the room.

Figure 14:
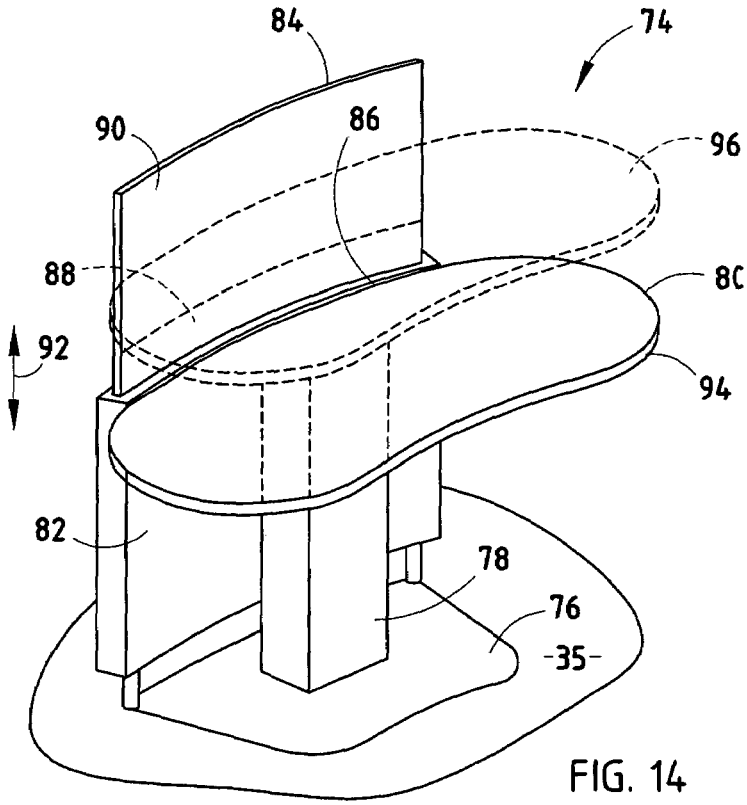
FIG. 14 is a perspective view of a third furniture system incorporating a height adjustable table therein.

Another second furniture system 74 (FIG. 14) includes a base member 76 supportable on the floor surface 35, a pedestal extending upwardly from and supported by the base member 76, and a worksurface 80 supported by the pedestal 78. The furniture system 74 also includes a partition member 82 extending upwardly from and supported by the base member 76. As illustrated, the pedestal 78 and the worksurface 80 are preferably spaced apart from the partition member 82. The partition member 82 includes a vertically-shiftable screen member 84 that is extendable from an upper edge 86 of the partition member 82. In the illustrated example, the screen member 84 is telescopingly received within the partition member 82 and is telescopingly slidable between a retracted position 88, and an extended position 90 in a direction as indicated and represented by directional arrow 92. Preferably, the screen member 84 is constructed of a translucent material, however, other materials may be utilized.

The worksurface 80 is also preferably vertically adjustable in the direction 92 between a lowered position 94 and a raised position 96. As illustrated, both the partition member 82 and the screen member 84 are arcuately shaped to match the arcuate shape of the worksurface 80, however, other configurations may be utilized. It should be noted that both the screen members 84 and the worksurface 80 may be provided in numerous geometrical configurations and complementary layouts.

Figure 15:
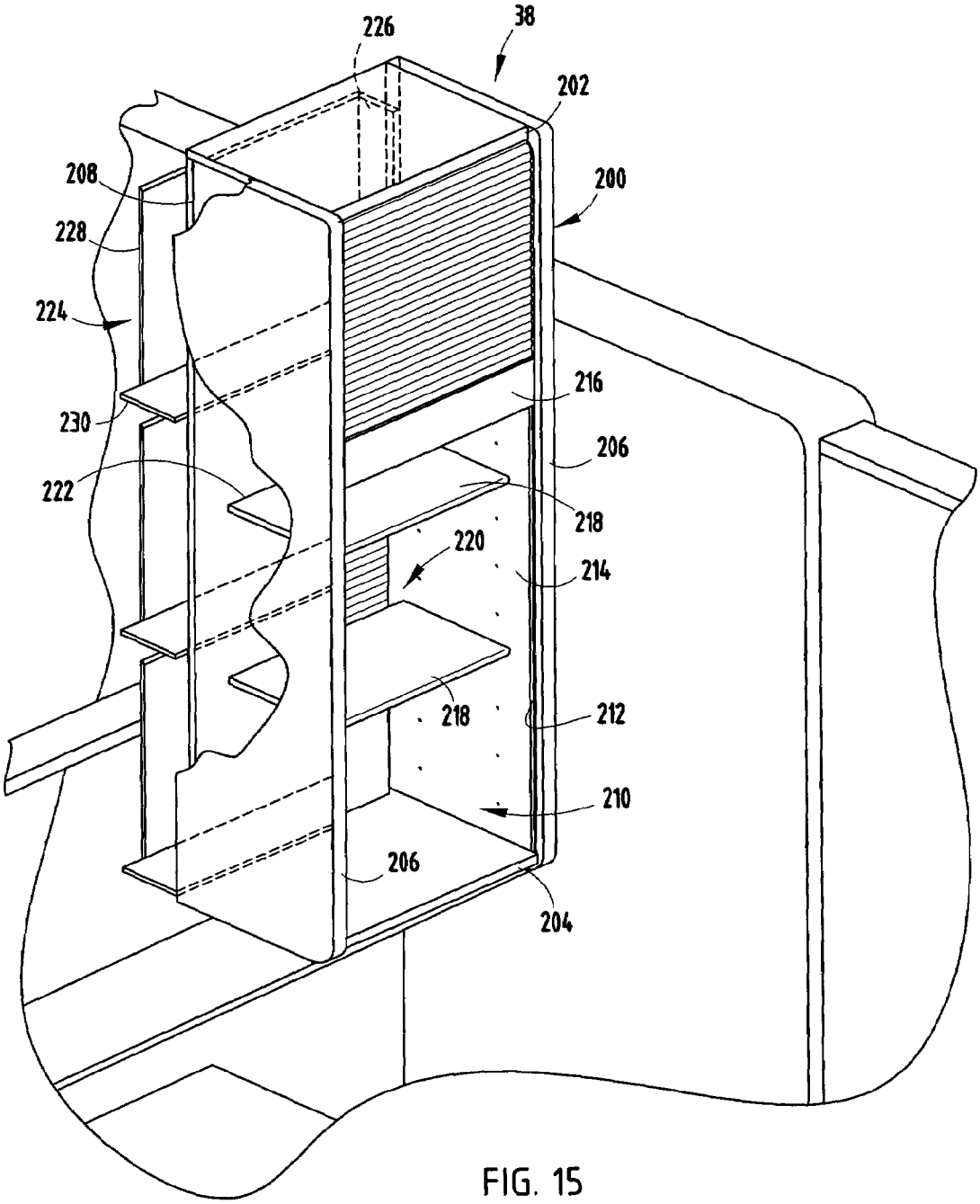
FIG. 15 is an enlarged perspective view of an overhead storage bin, taken of area XV-XV, FIG. 7.

The overhead storage unit 38 (FIG. 15) includes a housing 200 having a top wall 202, a bottom wall 204, a pair of side walls 206, and a rear wall 208 that cooperate to define an opening 210 that allows access to an interior of the housing 200. Each side wall 206 includes an inverted U-shaped track 212 extending inwardly into an inner surface 214 of the sidewall 206. A roll-away style door 216 is slidably received within the track 212 of each side wall 206, and is operable between a closed position, wherein the opening 210 is covered by the door 216, and an open position wherein the interior of the housing 200 is accessible. The overhead storage bin 38 also includes a plurality of shelves 218 spaced along the vertical length of the housing 200. The shelves 218 are supported by the side walls 206 and are configured so as to provide a gap 220 between a rear edge 222 of each shelf 218 and the rear wall 208 of the housing 200, thereby allowing space for the door 16 to be positioned when the door 216 is in the open position. The storage bin 38 further includes a plurality of shelving units 224 extending rearwardly from the rear wall 208 of the housing 200 and each including a side wall 226, a rear wall 228 and a bottom wall 230. The storage unit 38 is supported above the floor surface 35 by the partition assembly 16. The configuration and orientation of the storage unit 38 reduces the amount of floor space typically required for overhead storage bins, while simultaneously maximizing the storage space available both in and around the unit 38.

Figure 16:
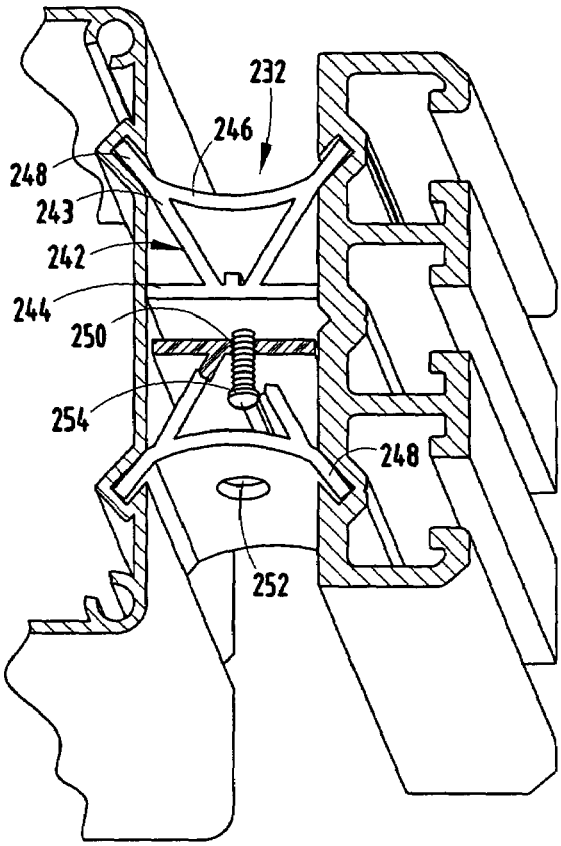
FIG. 16 is a cross-sectional perspective view of a coupling or connector assembly, taken along line XVI-XVI, FIG. 7.

A connector assembly 232 (FIG. 16) is utilized to couple multiple panel members 26 together, as is illustrated in FIG. 7. Specifically, the connector assembly 232 engages side frame members 234 of each panel member 26. More specifically, the side frame member 234 of each panel member 26 includes a pair of inwardly-extending slots or channels 236 extending along the length of the associated side frame member 234. Each channel 236 extends outwardly at a relative 45° angle with respect to an outer surface 238 of the side frame member 234. The connector assembly 232 includes a pair of engagement members 242 each having a pair of legs 243, a substantially planar inner wall 244 located at and integrally connected to a proximal end of the legs 243, a flexibly U-shaped web portion 246 located along a length of and integrally connected to the legs 243, and a pair of tab or engagement portions 248 located at a distal end of the legs 243. A plurality of threaded apertures 250 extend through the inner wall 244 and are spaced along the length of one of the engagement members 240. A plurality of access apertures 252 extend through the web portion 246 and are coaligned with the apertures 250. A plurality of mechanical fasteners such as screws 254 are threadably received within the aperture 250 of the inner wall 244.

Figure 17:
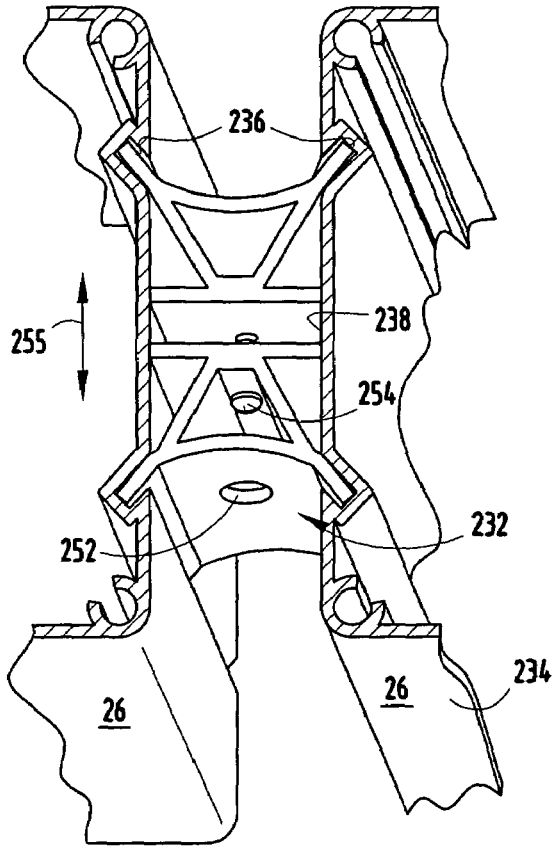
FIG. 17 is a cross-sectional perspective view of the coupling or connector assembly.

In assembly, the engagement members 240 are positioned so that the tab or engagement portions 248 of the engagement members 240 are located within the channels 236 of the side frame members 234 of a pair of adjacent panel members 26. The plurality of screws 254 (FIG. 17) are then accessed through the apertures 252 and are threaded into the associated apertures 250 such that each screw 254 abuts the inner wall 244 of the remaining engagement member 240, thereby forcing the engagement members 240 away from one another in a direction as indicated by directional arrow 255, the web portion 246 of each engagement member 240 to flex, and the tab or engagement portions 248 of each engagement member 240 to frictionally engage the channels 236 of the side frame members 234 and coupling the panel members 26 to one another. It should be noted that the connector assembly 232 allows vertical misalignment of panel members 26 with respect to one another when coupled together, thereby alleviating the necessity of exact alignment between the panel members 26 due to an uneven supporting surface, and the like.

Figure 18:
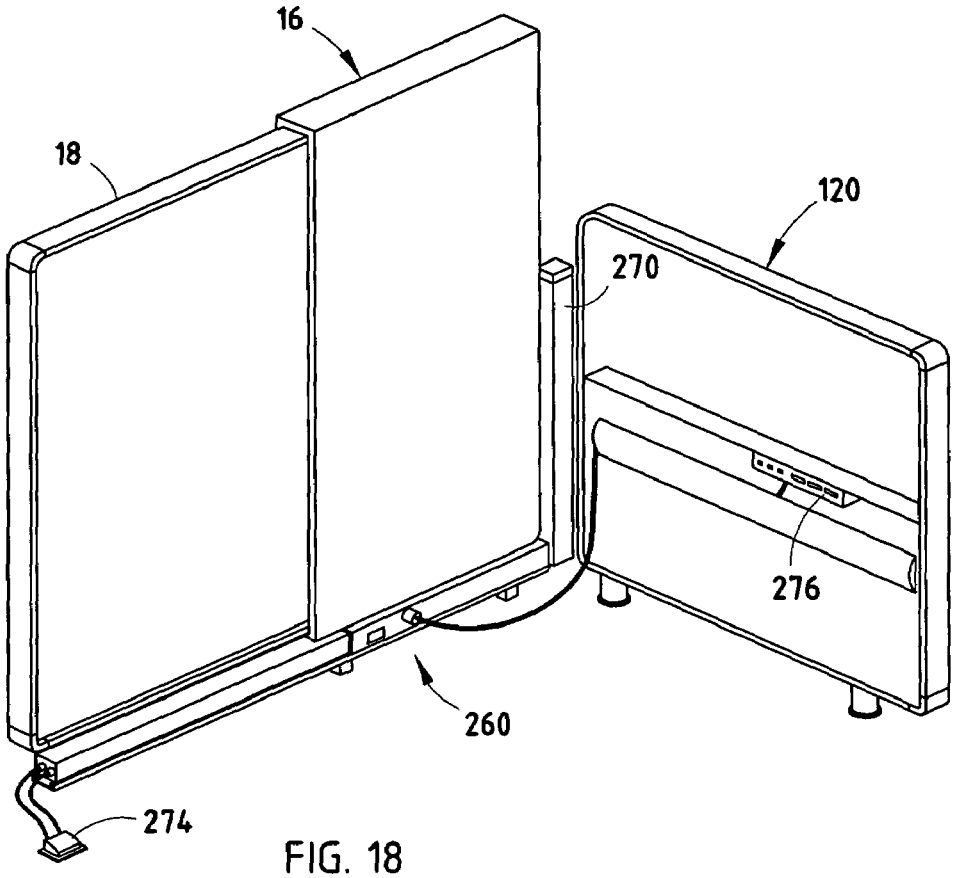
FIG. 18 is a perspective view of an adjustable power assembly within the furniture systems.
Figure 19:
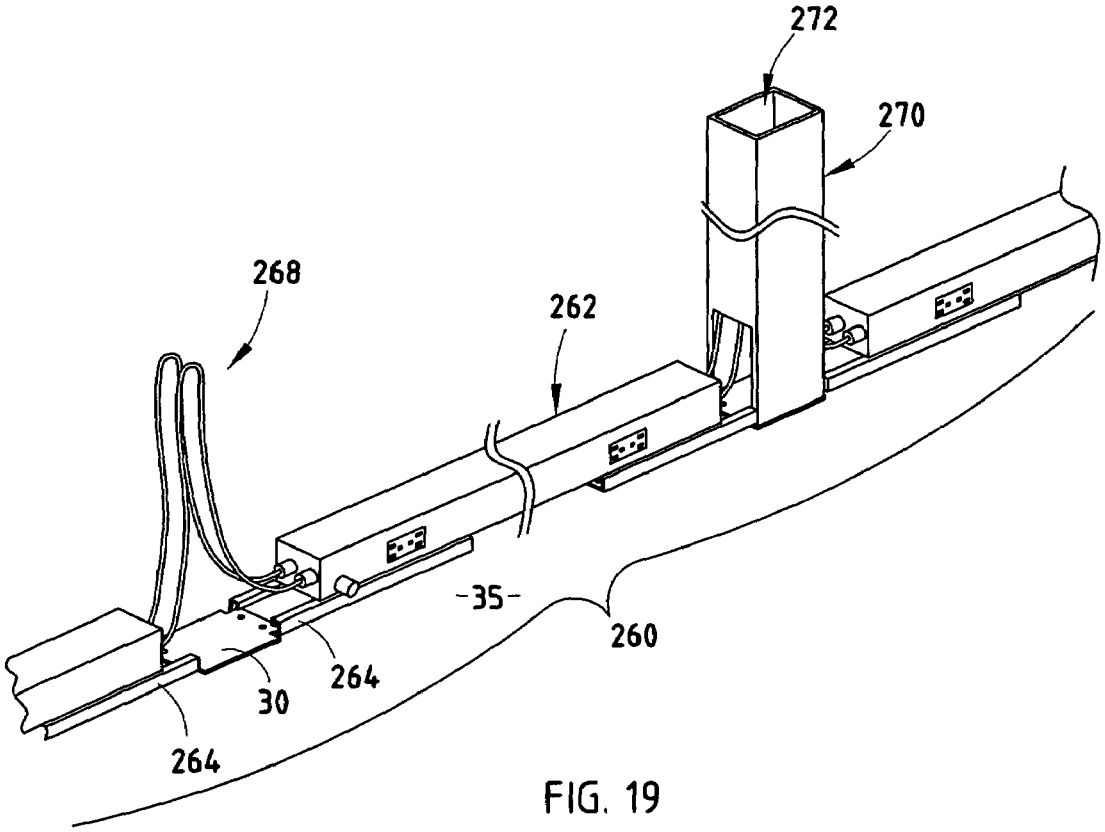
FIG. 19 is a perspective view of the adjustable power assembly.
Figure 20:
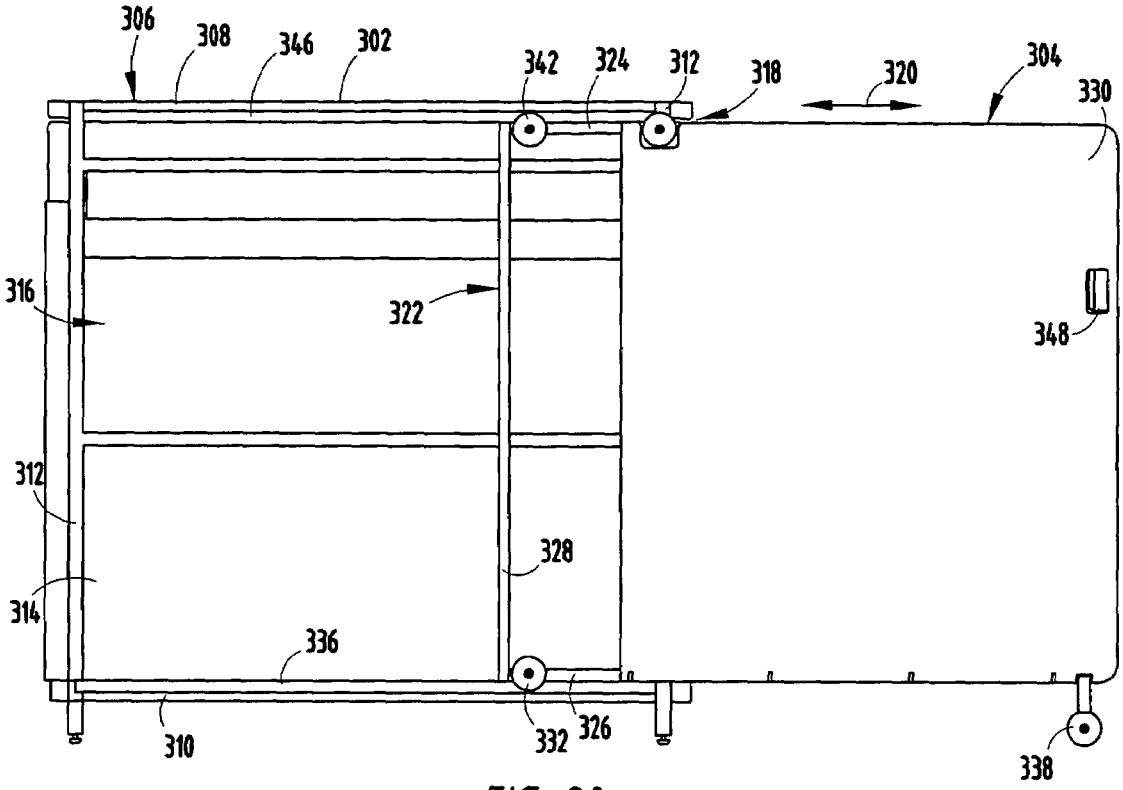
FIG. 20 is a cross-sectional view of a pocket screen within a partition wall, taken along the line XX-XX, FIG. 7.

The partition assembly 16 and the furniture system 120 (FIG. 7) further include an adjustable power assembly (FIG. 18). The power assembly 260 includes a plurality of power modules 262 slidably coupled with a plurality of track members 264, that are in turn fixed to the floor 35 via a plurality of floor plates 266. While the floor plates 266 may be permanently affixed to the floor 35, the floor plates 266 may also be removably coupled with the floor by adhesives, carpet hooks, and the like. The power modules 262 are connected in series with one another via a bendable wire harness 268. In assembly, a connector post 270 having a hollow interior 272 and extending upwardly from an associated floor plate 266 are spaced between the partition assembly 16 and a furniture system 120. Alternatively, the connector post 270 may be included within the construction of the partition assembly 16 and/or the furniture system 120, similarly to side frame member 234. In assembly, the wire harness 268 is received within the interior 272 of a connector post 270, and extends between and provides electrical communication between the power modules 262. At least one power module 262 within the assembly is connected to a power supply, such as a floor infeed 274, or a ceiling infeed (not shown). At least one power module 262 is in turn coupled with a power utility box 276 mounted to an underside of a sill assembly 134 and accessible to a user.

In operation, the power assembly 260 allows the screen member 18 to be horizontally shifted with respect to the panel member 16 while maintaining the power supply to the power modules 260 and the end utility box 276. Specifically, as the distance the screen member 18 is withdrawn from the panel member 16, the power modules 262 are allowed to slidably move with respect to the track member 264 and the floor plates 266. As the distance between the power modules 262 increases, the extra length of wire within each wire harness 268 is drawn from within the interior 272 of the associated post 270, thereby keeping the power modules 262 in electrical communication with one another.

Figure 21:
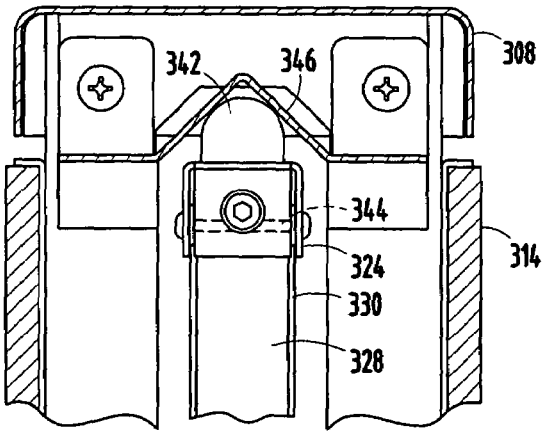
FIG. 21 is a partial cross-sectional view of the pocket screen within the partition panel, taken near the line XXI-XXI, FIG. 7.
Figure 22:
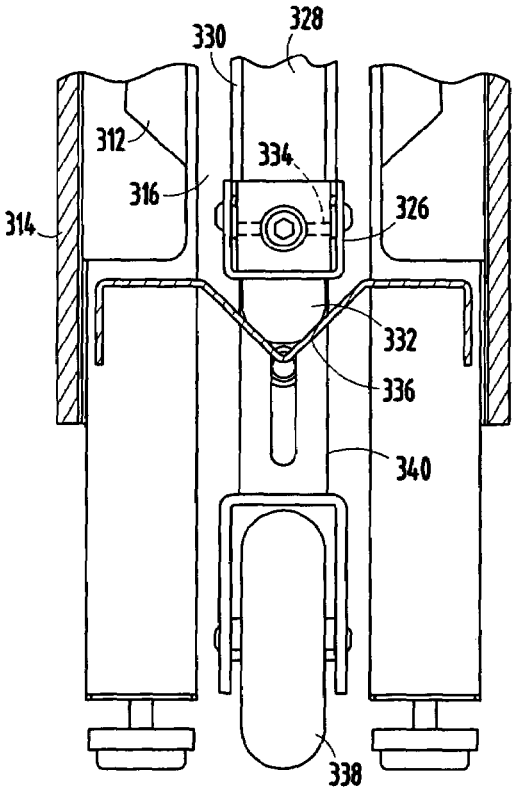
FIG. 22 is a partial cross-sectional view of the pocket screen within the partition panel, taken near the line XXII-XXII, FIG. 7.

The plurality of furniture systems 10, as illustrated in FIG. 7, further includes a furniture system 300 having a partition panel member 302, a pocket screen 304 slidably received within the panel member 302, and a desk assembly operably coupled to the partition panel 302. The panel member includes an outer frame assembly 306, including a top frame member 308, a bottom frame member 310, and a pair of side frame members 312. The frame assembly 306 is covered by a pair of planar outer skins 314 that cooperate with the frame assembly 306 to define an enclosed interior 316. At least one of the side frame members 312 includes a slot defined aperture 318 that slidably receives the pocket screen 304 within the interior 316 in a direction of movement as represented by directional arrow 320. The pocket screen 304 includes an outer frame assembly 322 having an upper frame member 324, a lower frame member 326, and a pair of side frame members 328. The frame assembly 322 is covered by an outer skin 330 that is preferably opaque. The pocket screen 304 is slidably supported by a lower roller or wheel 332 (FIG. 21) pivotably coupled to the lower frame member 326 by a pivot pin 334, and that guides along a V-shaped lower guide rail 336 that extends along with the lower frame member 310 of the panel member 302. The pocket screen 304 is further supported by a wheel or castor 338 that guides along the floor surface 35, and is operably coupled to the lower frame member 326 of the pocket screen 304 by a downwardly-extending leg 340. The top of the pocket screen 304 is slidably or rollably guided by a pair of upper rollers or wheels 342 (FIG. 22) pivotably coupled to the upper frame member 324 by a pivot pin 344, and that guide along a V-shaped upper guide rail 346 that extends along with the upper frame member 308 of the panel member 302.

In operation, the pocket screen 304 is slidably operated by grasping a handle relief 348 within the pocket screen 304, and sliding the pocket screen 304 in a selective direction 320. The cooperation of the lower roller 332 and the upper rollers 342 with the V-shaped lower and upper guide rails 336, 346 serve to center the pocket screen 304 with respect to the partition panel member 302 and the aperture 318, thereby eliminating the necessity of other centering devices.

Figure 3:
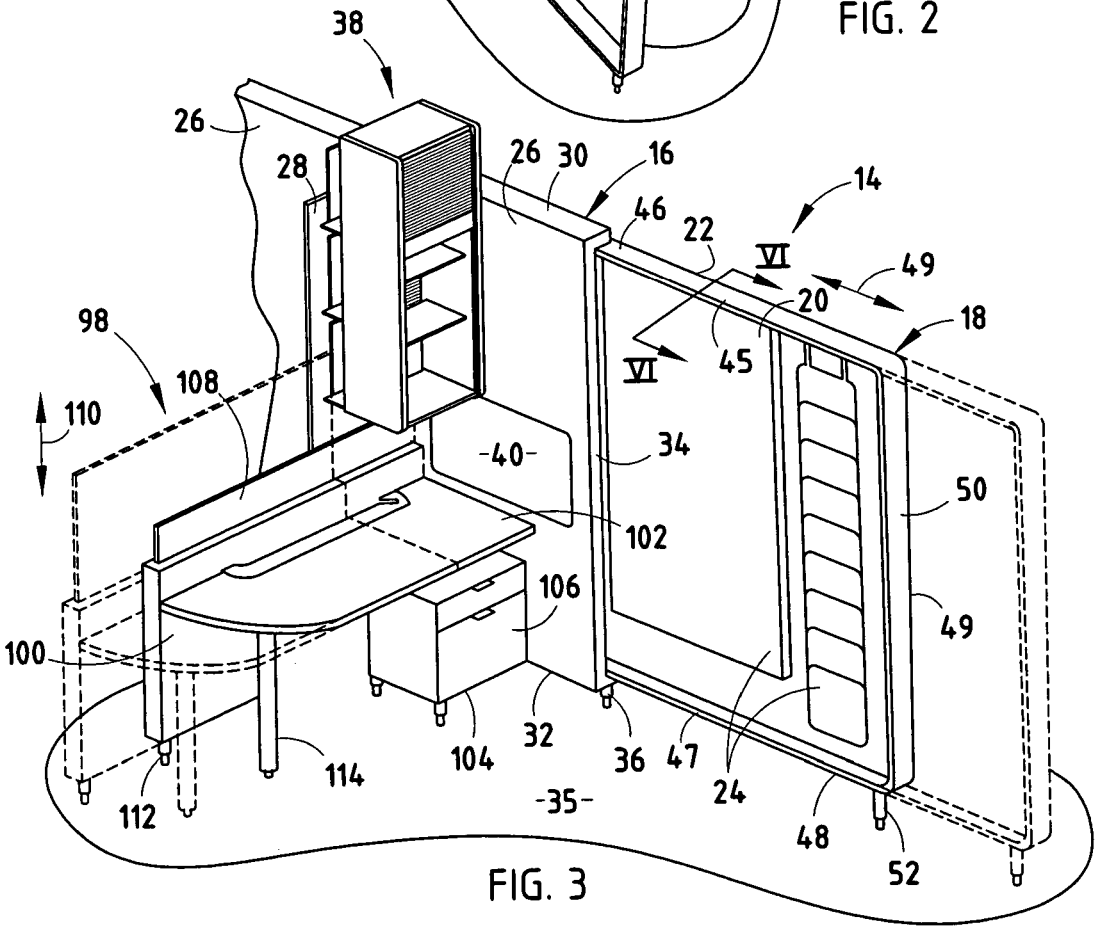
FIG. 3 is a perspective view of a first furniture system, wherein a first partition member is shown including a laterally shiftable screen member shown in a retracted position in solid line, and an extended position in dotted line, a worksurface shown in a first position in solid and a second position in dashed line, and a vertically shiftable screen member shown in a retracted position in solid line, and an extended position in dashed line.
Figure 4:
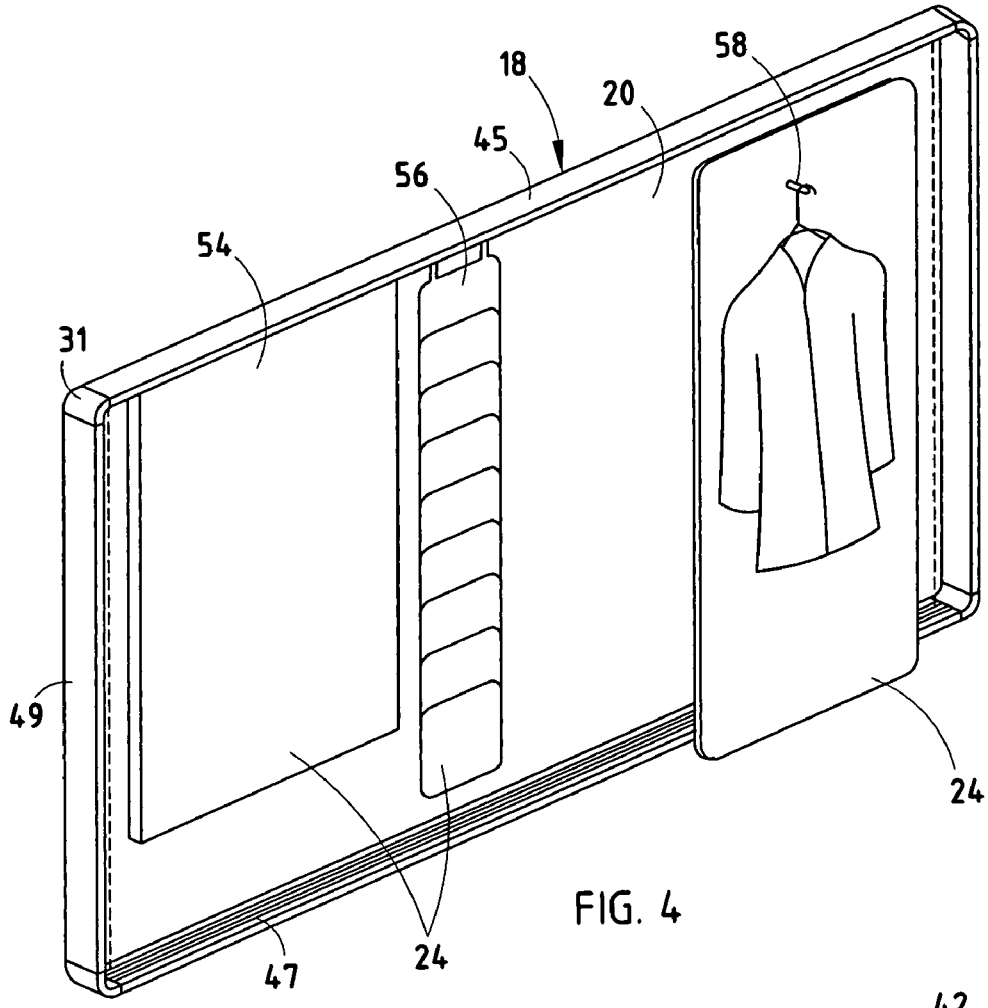
FIG. 4 is a perspective view of the laterally-shiftable screen member including a plurality of accessory units.

As is best illustrated in FIG. 3, the plurality of furniture systems 10 cooperate to organize an subdivide or bifurcate the space 12 within a room. The present inventive furniture systems provide an uncomplicated design, can be easily and quickly assembled to subdivide an open space of a room, and are therefore efficient in use, provide a low-cost alternative to furniture systems that include an arrangement of complicated and difficult to assemble partition panels, allow for simplified ordering, assembly and managing of furniture assets and are particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A connector assembly for a free-standing partition-type office system including a plurality of panel members, each panel member having at least one frame member, the at least one frame member having a pair of inwardly-extending channes, the connector assembly comprising:

a pair of engagement members, each engagement member including a pair of legs, an inner wall located at and connected to a proximal end of the legs, a web portion located along a length of and connected to the legs, and a pair of tab portions located at a distal end of the legs, wherein the inner wall of at least one of the engagement members includes an aperture extending therethrough; and an actuator operably received within the aperture of the inner wall of one of the engagement members such that selective actuation of the actuator member forces the inner walls of the pair of engagement members away from one another, and wherein the tab portions are adapted to frictionally engage a pair of channels of a frame member, thereby coupling a pair of panel members together.

2. The connector assembly of claim 1, wherein the legs, the inner wall, the web portion and the tab portion of each engagement member are integrally formed.

3. The connector assembly of claim 2, wherein each engagement member is formed via extrusion.

4. The connector assembly of claim 3, wherein each engagement member is substantially V-shaped.

5. The connector assembly of claim 4, wherein the actuator member is a threaded fastener threadably received within the aperture of the inner wall, such that threading the fastener into the aperture of the inner wall of one of the pair of engagement members causes the fastener to abut the inner wall of the remaining one of the pair of engagement members.

6. The connector assembly of claim 5, wherein the web portion of the engagement member not including the aperture within the inner wall includes an aperture extending therethrough that provides access to the actuator.

7. The connector assembly of claim 1, wherein the web portion of each of the engagement members is flexibly resilient, and wherein selective actuation of the actuator member flexes the web portion of each of the engagement members.

8. A free-standing partition-type system adapted to subdivide an open space of a room, comprising:

a first panel member having a first frame member extending along an edge thereof, wherein the first frame member includes a pair of channels extending along a length thereof;

a second panel member having a second frame member extending along an edge thereof, wherein the second frame member includes a pair of channels extending along a length thereof;

a pair of engagement members, each engagement member including a pair of legs, an inner wall located at and connected to a proximal end of the legs, a web portion located along a length of and connected to the legs, and a pair of tab portions located at a distal end of the legs, wherein the inner wall of at least one of the engagement members includes an aperture extending therethrough; and an actuator operably received within the aperture of the inner wall of one of the engagement members such that selective actuation of the actuator member forces the inner walls of the pair of engagement members away from one another, and the tab portions of each engagement member to frictionally engage one of the channels of the frame member of each of the panel members, thereby coupling the first and second panel members.

9. The system of claim 8, wherein the legs, the inner wall, the web portion and the tab portion of each engagement member are integrally formed.

10. The system of claim 9, wherein each engagement member is formed via extrusion.

11. The system of claim 8, wherein each engagement member is substantially V-shaped.

12. The system of claim 8, wherein the actuator member is a threaded fastener threadably received within the aperture of the inner wall, such that threading the fastener into the aperture of the inner wall of one of the pair of engagement members causes the fastener to abut the inner wall of the remaining one of the pair of engagement members.

13. The system of claim 12, wherein the web portion of the engagement member not including the aperture within the inner wall includes an aperture extending therethrough that provides access to the actuator.

14. The system of claim 8, wherein the web portion of each of the engagement members is flexibly resilient, and wherein selective actuation of the actuator member flexes the web portion of each of the engagement members.

15. A connector assembly for a free-standing partition-type office system including a plurality of panel members, each panel member having at least one frame member, the at least one frame member having a pair of inwardly-extending channels, the connector assembly comprising:

a pair of engagement members, each engagement member including a pair of legs, an inner wall located at and connected to a proximal end of the legs, a web portion located along a length of and connected to the legs, wherein a portion of the web is spaced from the legs, and a pair of tab portions located at a distal end of the legs, wherein the inner wall of at least one of the engagement members includes an aperture extending therethrough; and an actuator operably received within the aperture of the inner wall of one of the engagement members such that selective actuation of the actuator member forces the inner walls of the pair of engagement members away from one another, and wherein the tab portions are adapted to frictionally engage a pair of channels of a frame member, thereby coupling a pair of panel members together.

16. A free-standing partition-type system adapted to subdivide an open space of a room, comprising:

a first panel member having a first frame member extending along an edge thereof, wherein the first frame member includes a pair of channels extending along a length thereof;

a second panel member having a second frame member extending along an edge thereof, wherein the second frame member includes a pair of channels extending along a length thereof;

a pair of engagement members, each engagement member including a pair of legs, an inner wall located at and connected to a proximal end of the legs, a web portion located along a length of and connected to the legs, wherein a portion of the web is spaced from the legs and a pair of tab portions located at a distal end of the legs, wherein the inner wall of at least one of the engagement members includes an aperture extending therethrough; and an actuator operably received within the aperture of the inner wall of one of the engagement members such that selective actuation of the actuator member forces the inner walls of the pair of engagement members away from one another, and the tab portions of each engagement member to frictionally engage one of the channels of the frame member of each of the panel members, thereby coupling the first and second panel members.

* * * * *

UNITED STATES PATENT AND TRADEMARK OFFICE

CERTIFICATE OF CORRECTION

PATENT NO. : 7,707,790 B2
APPLICATION NO. : 10/835430
DATED : May 4, 2010
INVENTOR(S) : Otto N. Williams et al.

It is certified that error appears in the above-identified patent and that said Letters Patent is hereby corrected as shown below:

Col. 1, line 40
"fastened opposite" should be -- fastened to opposite --

Col. 2, line 37
"and" should be -- an --

Col. 2, line 50
"such the" should be -- such that the --

Col. 3, line 52
"freestanding" should be -- free-standing --

Col. 3, line 64
"received the" should be -- received within the --

Col. 4, line 5
"freestanding" should be -- free-standing --

Figure 7A:
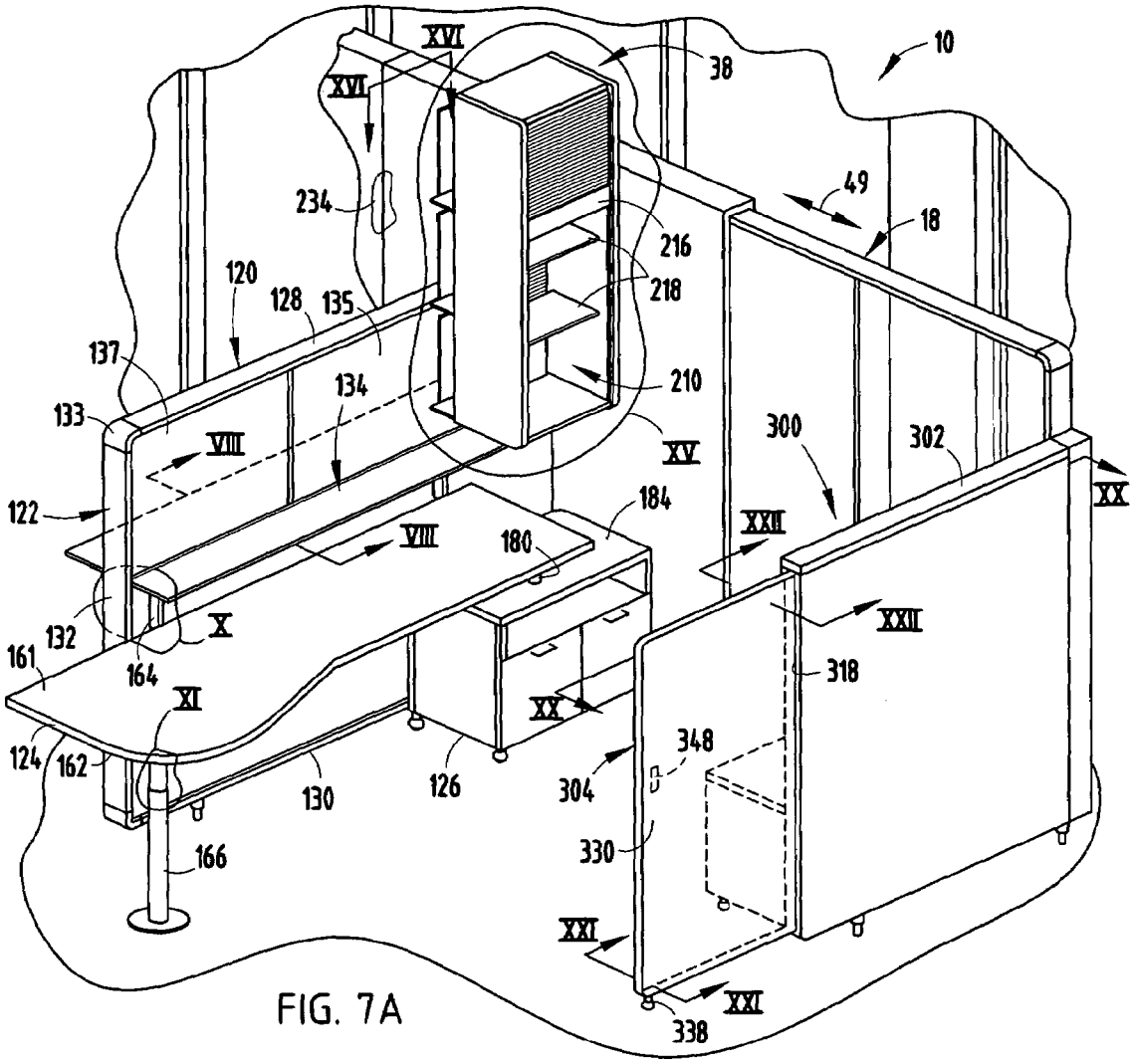
FIG. 7A is a perspective view of a plurality of alternative furniture systems including a first furniture system, wherein a first partition member is shown including a laterally shiftable screen member shown in a retracted position in solid line, and an extended position in dotted line.
Figure 7B:
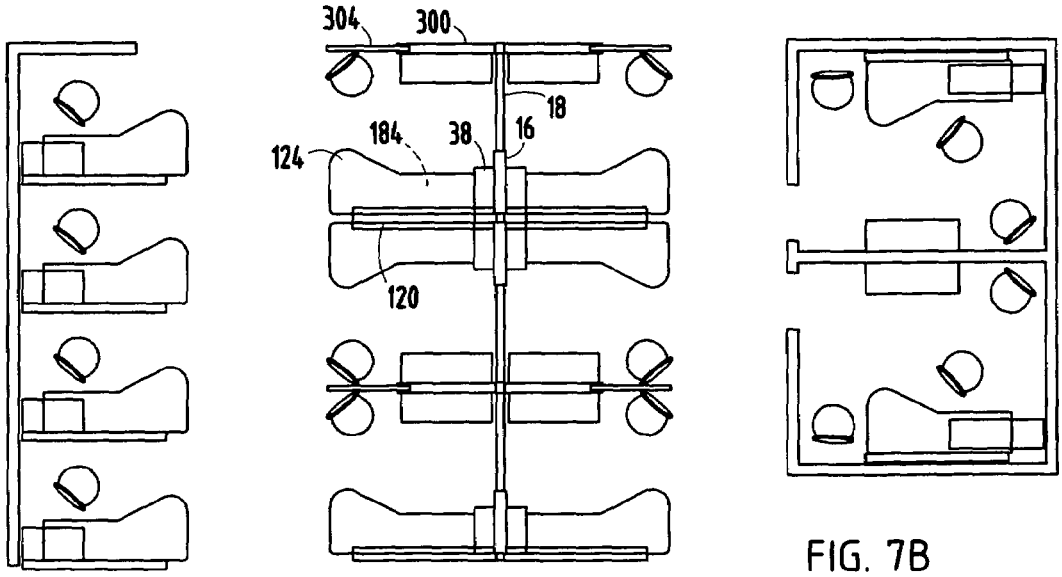
FIG. 7B is a top plan view of the plurality of alternative furniture systems of FIG. 7A.

Col. 5, lines 6, 11, 14, 17, 24, 26, 34, 36, 40
"Fig. 7" should be -- Fig. 7A --

Col. 10, line 50
"are" should be -- is --

Col. 10, line 67
"power modules 260" should be -- power modules 262 --

Cols. 10-11, lines 67-2
"16, the" should be -- 16 increases, the --

Col. 11, line 32
"castor" should be -- caster --

Signed and Sealed this

Twenty-fourth Day of August, 2010

David J. Kappos

David J. Kappos
*Director of the United States Patent and Trademark Office*

Col. 11, line 45
"serve" should be -- serves --

Col. 11, line 50
"an" should be -- and --

Col. 12, line 3
"channes" should be -- channels --